United States Patent [19]

Matsui

[11] 4,052,581

[45] Oct. 4, 1977

[54] SWITCH WITH MOVABLE AND FIXED CONTACTS

[75] Inventor: Shigeru Matsui, Hamamatsu, Japan

[73] Assignee: Nippon Gakki Seizo Kabushiki Kaisha, Hamamatsu, Japan

[21] Appl. No.: 626,557

[22] Filed: Oct. 28, 1975

[30] Foreign Application Priority Data

Oct. 29, 1974 Japan ..... 49-130655[U]

[51] Int. Cl.[2] ..... H01H 50/56

[52] U.S. Cl. ..... 200/283; 335/135

[58] Field of Search ..... 200/237-251, 200/1 B, 1 V, 1 TK, 6 BB, 6 BA, 6 C, 159 A, 283, DIG. 46; 335/135

[56] References Cited

U.S. PATENT DOCUMENTS

| | | | |
|---|---|---|---|
| 1,132,094 | 3/1915 | Hosford | 200/267 |
| 2,616,993 | 11/1952 | Koehler | 335/135 |
| 3,750,060 | 7/1973 | Pfenning | 335/135 |
| 3,978,303 | 8/1976 | Miyata | 200/246 |

*Primary Examiner*—Robert K. Schaffer
*Assistant Examiner*—Morris Ginsburg
*Attorney, Agent, or Firm*—Cushman, Darby & Cushman

[57] ABSTRACT

A switch is comprised of at least one leaf-like springy fixed contact, a movable contact, a supporting member for supporting the fixed contact and a positioning member for positioning the free end of the fixed contact. The leaf-like fixed contact is fixed by the supporting member at a position close to one end of the fixed contact, and is biased by the positioning member at a position close to the other end. Thus, the free end of the leaf-like springy fixed contact is placed at a position by its function of urging the positioning member.

14 Claims, 13 Drawing Figures

SWITCH WITH MOVABLE AND FIXED CONTACTS

BACKGROUND OF THE INVENTION a. Field of the Invention

The present invention concerns a switch having a leaf (blade)-like springy fixed or movable contact, and more particularly it pertains to a switch which is suitable for use as, for example, a tablet switch of an electronic organ, a switch of a pedal keyboard, a switch of a manual keyboard of an electronic piano and a power relay switch.

b. Description of the Prior Art

A known switch of the above-mentioned type is shown in FIG. 13. This switch is comprised of a pair of leaf-like fixed springy contacts 21 and 22 supported at points close to one ends thereof by a holder 24, and a movable contact 23 which is arranged between said pair of leaf-like contacts 21 and 22. Such a known switch is structured so that the other ends of the leaf-like fixed contacts are free. Therefore, it has been quite difficult to precisely correctly position the free ends of the fixed contacts relative to the movable contact and to other fixed contacts during the operation of assembling the switch-constituting elements. Moreover, the known switch of this type has the further disadvantage that, during the use of the switch for an extended period of time, the spring force of the leaf-like contacts progressively becomes weakened, with the result that the pressure of contact between the fixed contacts and the movable contact becomes unstable. Owing to such variance in the position of the fixed contacts and also to the unstable contact of pressure between these contacts, there has been encountered the inconveniences which are represented by the tendency to develop variance in the timing of the "on-off" actions of the switch and to develop chattering during such actions. For these reasons, the employment of such a known switch in an electronic musical instrument such as an electronic organ having keyboards invariably imparts undesirable effects on the performance of the musical instrument due to variance in time of the switching actions.

SUMMARY OF THE INVENTION

It is, therefore, an object of the present invention to provide a switch having an arrangement which insures the precise correct positioning of the free ends of the springy fixed contacts at desired positions.

Another object of the present invention is to provide a switch of the type described above, which is such that the positions of the springy fixed contacts will not alter during the use for an extended period of time.

Still another object of the present invention is to provide a switch of the type described above, which insures a stabilized pressure of contact between the springy contacts and the movable contact during the use for a lengthy period of time.

A further object of the present invention is to provide a holding member of integral type which is capable of supporting the contact members and also capable of making precise correct positioning of the free ends of the contact members.

These and other objects as well as the advantages of the present invention will become apparent by reading the following detailed description when taken in conjunction with the accompanying drawings.

DETAILED DESCRIPTION OF THE PREFERRED EMBODIMENTS

Figure 1:
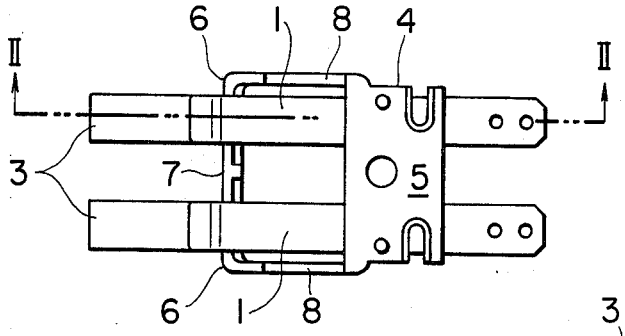
FIG. 1 is a sectional view of a break type changeover switch according to the present invention.
Figure 2:
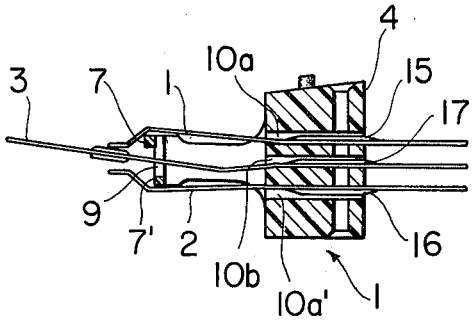
FIG. 2 is a sectional view taken along the line II—II in FIG. 1.

FIGS. 1 and 2 show a switch having two changeover switches which are incorporated in the switch as integral members of this switch. The switch is comprised of mutually facing a pair of leaf-like springy fixed contacts 1 and 2, a leaf-like springy movable contact 3 which is arranged between these fixed contacts 1 and 2, and a holding member 4 for supporting these leaf-like contacts 1, 2 and 3.

As shown in FIGS. 3 to 6, the holding member 4 is comprised of a supporting block 5 having channels **10*a*, 10*a*' and 10*b* for insertion therethrough of the leaf-like contacts 1, 2 and 3, a coupling portion 8 extending in the direction of extension of said channels 10*a*, 10*a*' and 10*b* from said supporting block 5, and frame 6 for positioning the leaf-like fixed contacts 1 and 2. As will be understood from FIG. 2, the positioning frame 6 has cross bars 7 and 7' whose upper and lower ends are arranged so that these ends are positioned somewhat above and below the extensions of the channels 10*a* and 10*a*', respectively. This frame 6 has an opening 9 for the passage therethrough of the movable contact 3 in order to allow the movable contact 3 to move vertically in FIG. 3.**

Figure 7:
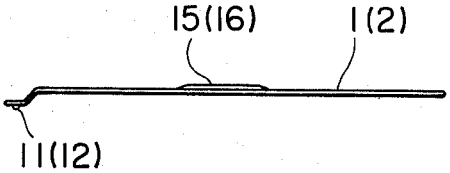
FIG. 7 is a side view of the leaf-like springy fixed contact shown in FIG. 1.
Figure 8:
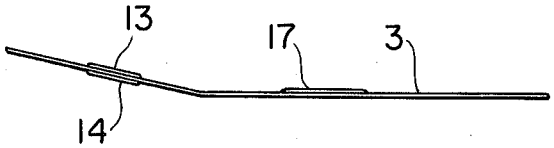
FIG. 8 is a side view of the leaf-like springy movable contact shown in FIG. 1.

The leaf-like fixed contacts 1 and 2 and the leaf-like movable contact 3 are made with, for example, German silver. The details of the structure and arrangement of these contacts are as shown in FIG. 7. The leaf-like fixed contacts 1 and 2 are bent in a crank form at a position near their free ends. Both the leaf-like fixed contacts 1 and 2 and the movable contact 3 have contact tips 11, 12, 13 and 14 which are made of a precious metal and which are provided at positions at which these contacts are in contact with each other, respectively. These contact tips 11, 12, 13 and 14 may be made with linear strips of a precious metal. The leaf-like contacts 1, 2 and 3 have bulging portions 15, 16 and 17 at positions close to their one ends. The leaf-like movable contact 3 is bent somewhat upwardly between its point of contact and its bulging portion to provide a break-type contact between the fixed contact 1 and the movable contact 3.

As shown in FIGS. 1 and 2, the leaf-like fixed contacts 1 and 2 are received in the channels 10*a* and 10*a'*, respectively, and these fixed contacts 1 and 2 are fixed at positions at which the bulging portions 15 and 16 engage in the channels 10*a* and 10*a'*. The free ends of the fixed contacts 1 and 2 are mounted on the cross bars 7 and 7' of the positioning frame 6, respectively. As stated previously, the upper and the lower ends of the cross bars 7 and 7' protrude above and below the lines of extensions of channels 10*a* and 10*a'*, respectively. Accordingly, the free ends of the fixed contact 1 and 2 are biased to a small extent in the directions away from each other by these cross bars 7 and 7'. As a result, the fixed contacts 1 and 2 are brought into pressure contact with the cross bars 7 and 7' and thus these fixed contacts are held in precise correct positions.

The leaf-like movable contact 3, on the other hand, is received in channel 10*b*. This contact 3 is fixed at a position at which the bulging portion 17 engages in the channel 10*b*. The free end of the movable contact 3 extends through the opening 9 of the positioning frame 6 and beyond the free ends of the fixed contact 1 and 2. In the switch shown in FIG. 2, the movable contact 3 is of the arrangement that it normally is in contact with the illustrated upper fixed contact 1 in such a way as to urge this fixed contact 1 to depart from the positioning frame 6. This switch is changed over in its connection by moving the free end of the movable contact 3 by an operating means not shown. The operating means may employ any known such means which is, for example, a mechanically functioning manual actuator or a relay coil which functions electrically.

Figure 3:
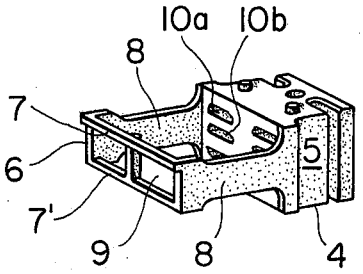
FIG. 3 is a perspective view of the holding member for the contact members.
Figure 4:
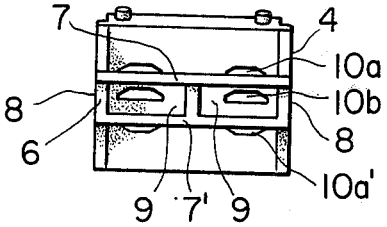
FIG. 4 is a front view of the holding member shown in FIG. 3.
Figure 5:
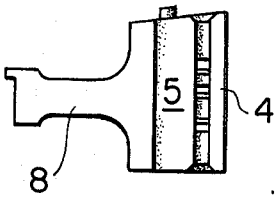
FIG. 5 is a side view of the holding member shown in FIG. 3.
Figure 6:
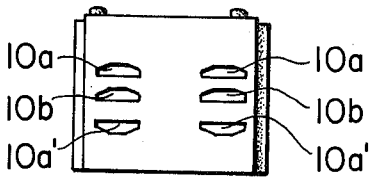
FIG. 6 is a rear view of the holding member shown in FIG. 3.

The fixed contacts 1 and 2 are urged, by the aforesaid arrangement, so that they are always held in their positions of leaning against the cross bars 7 and 7'. As such, the foremost ends of these fixed contacts 1 and 2 are placed in precise correct positions. Also, the fixed contact 1 is biased by the cross bar 7'. Accordingly, the movable contact 3 is moved for a relatively small distance to be brought into contact with the fixed contact 2, thereby urging this fixed contact 2 to part away from the cross bar 7'. Thus, there is obtained a sufficient pressure of contact between the two contacts 3 and 2. As a result, the occurrence of undesirable chattering can be avoided. The positioning frame 6 can also be structured independently of the holding member 4. As shown in FIG. 3, however, it will be desirable to arrange or mold the positioning frame 6 integrally as one piece with the contact-holding member 4 from the viewpoints not only of cost of manufacture and assembling but also of carrying out a precise and correct positioning of the contacts. The holding member 4 as shown in FIG. 3 can be molded by the use of an insulating material such as plastic material. More specifically, as will be understood from FIG. 2, the cross bars 7 and 7' of the positioning frame 6 are staggering forward and backward with respect to their common vertical end edge lines. Therefore, they can be formed, relying on the molding technique, by the use of an upper mold and a lower mold. In such a molding process, the channels 10*a*, 10*a'* and 10*b* can be formed by inserting a pin-like mold piece from the right side of the assembly in FIG. 2.

Figure 9:
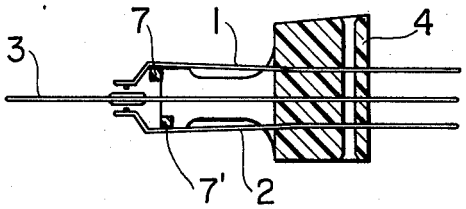
FIG. 9 is a sectional view of a make-type changeover switch according to the present invention.

Either of the fixed and movable contacts 1, 2 and 3 can be structured also by the use of a linear or a rod-like contact, in place of the leaf-like contact as shown in the switch of FIG. 1. Also, as will be noted in FIG. 2, the movable contact 3 of the switch is shown as normally being in contact with one of the fixed contacts. It should be understood, however, that, as shown in FIG. 9, it is possible to form a switch of the type that the movable contact is positioned intermediate of the two fixed contacts. In FIG. 9, like parts are mentioned by like reference numerals.

In the example shown in FIG. 1, there is mentioned a switch having a pair of fixed contacts. It should be undetstood that the number of fixed contacts may be varied depending on the use of the switch.

Figure 10:
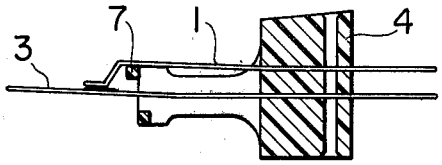
FIG. 10 is a sectional view of a break-type single contact.
Figure 11:
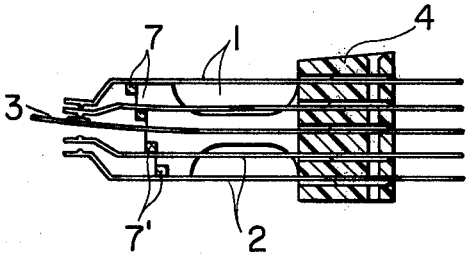
FIG. 11 is a sectional view of parallel arranged dual contacts.
Figure 12:
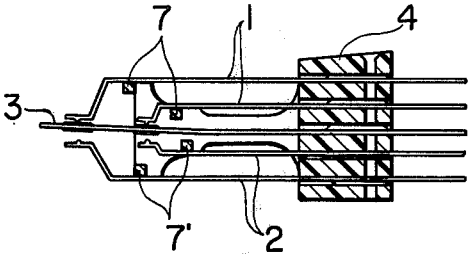
FIG. 12 is a sectional view of series arranged dual contacts.
Figure 13:
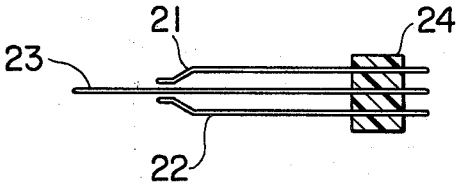
FIG. 13 PRIOR ART
FIG. 13 is an explanatory illustration of a switch of known type.

In FIG. 10 is shown an example of a switch having a single leaf-like fixed contact. In FIG. 11 is shown parallely arranged dual contacts having four fixed contacts. In FIG. 12 is shown series arranged dual contacts having four fixed contacts. Like parts are mentioned by like reference numerals.

Furthermore, in FIG. 1 is shown a switch mechanism arranged so that two switches are placed in parallel relation. It will be clearly understood that the switch mechanism is comprised of a single switch, and that three or more switches are combined to form a switch mechanism.

The present invention has been described on some examples. It should be noted that the present invention is not limited thereto, but that various modifications and variations may be made without departing from the spirit and scope of the present invention which is defined in the attendant claims.

I claim:

1. A switch comprising:

at least one springy fixed contact member having a free end;

a springy movable contact member having a free end and capable of being moved by application of force to its free end into and out of contact with said fixed member;

a supporting member supporting said fixed and movable members with the free end of said movable member extending beyond the free end of said fixed member; and a positioning means fixed to said supporting member and disposed between said free ends of said fixed and movable members and said supporting member for positioning said fixed and movable members for movement into and out of contact.

2. A switch as in claim 1, wherein said free end of said fixed member is bent toward said free end of said movable member.

3. A switch as in claim 1, wherein said free end of said movable member is bent toward said free end of said fixed member.

4. A switch as in claim 1, including at least first and second fixed contacts supported on opposite sides of said movable member to form, with said movable contact, a switch unit.

5. A switch as in claim 4, including a plurality of switch units supported side by side by said supporting member.

6. A switch as in claim 1, wherein said supporting member comprises a block having a plurality of channels extending therethrough for each receiving a contact member and each contact member has a bulging portion engaging a channel.

7. A switch as in claim 6, wherein said positioning means includes a frame having at least upper and lower cross bars over and under which respectively fixed contact members extend.

8. A switch as in claim 1, wherein said contact members are German silver.

9. A switch as in claim 1, including at least four fixed members, one pair mounted on either side of said movable member.

10. A switch as in claim 9, wherein one contact member of each pair extends beyond the free end of the other contact member of that pair so that the contact members of each pair are electrically connected via said movable member.

11. A switch as in claim 1, wherein said contact members have a leaf-like shape.

12. A switch as in claim 1, wherein said supporting means and positioning member are formed as a single insulating piece.

13. A switch as in claim 1 wherein said positioning means includes a frame having upper and lower cross bars displaced horizontally with respect to each other, said frame formed as an integral piece of insulating material by a mold.

14. A switch as in claim 6, wherein said positioning means includes a frame having at least upper and lower cross bars over which said fixed contact member extends while said movable contact member extends between the upper and lower cross bars.

* * * * *